US009463910B2

(12) United States Patent
Schandl

(10) Patent No.: US 9,463,910 B2
(45) Date of Patent: Oct. 11, 2016

(54) CONTAINER CLOSURE DEVICE AND CONTAINER HAVING SUCH A CLOSURE DEVICE

(75) Inventor: Christian Schandl, WR. Neustadt (AT)

(73) Assignee: c2c Beteiligungs—GmbH, München (DE)

( * ) Notice: Subject to any disclaimer, the term of this patent is extended or adjusted under 35 U.S.C. 154(b) by 328 days.

(21) Appl. No.: 13/639,776

(22) PCT Filed: Apr. 4, 2011

(86) PCT No.: PCT/EP2011/055209

§ 371 (c)(1),
(2), (4) Date: May 23, 2013

(87) PCT Pub. No.: WO2011/124552

PCT Pub. Date: Oct. 13, 2011

(65) Prior Publication Data

US 2013/0228586 A1 Sep. 5, 2013

(30) Foreign Application Priority Data

Apr. 6, 2010 (AT) ..... A 545/2010

(51) Int. Cl.
*B65D 43/16* (2006.01)
*B65D 45/22* (2006.01)
(Continued)

(52) U.S. Cl.
CPC ..... *B65D 43/162* (2013.01); *B65D 43/22* (2013.01); *B65D 43/24* (2013.01); *B65D 43/265* (2013.01);
(Continued)

(58) Field of Classification Search
CPC .... B65D 43/22; B65D 43/24; B65D 43/162; B65D 43/265; B65D 17/166; B65D 51/1683; B65D 51/1688; B65D 2205/02; B65D 2517/0014; B65D 2517/0025
USPC ..... 220/231, 254.4, 254.7, 268, 271, 825, 220/832, 833, 838, 849, 906
See application file for complete search history.

(56) References Cited

U.S. PATENT DOCUMENTS 3,698,593 A 10/1972 Cvacho et al.
3,952,914 A 4/1976 Vogt
(Continued)

FOREIGN PATENT DOCUMENTS

AT 507950 A1 9/2010
CN 1764576 A 4/2006
(Continued)

OTHER PUBLICATIONS

International Search Report in corresponding International Application No. PCT/EP2011/055209 mailed Aug. 25, 2011 (10 pages).
(Continued)

*Primary Examiner* — Fenn Mathew
*Assistant Examiner* — Madison L Poos
(74) *Attorney, Agent, or Firm* — Thomas B. Ryan, Patent Agent

(57) ABSTRACT

A container closure device (20) for a container (10), in particular for a beverage can (10), comprises a lid (30) having an upper face (31), a lower face (32), and an opening (33). The container closure device (20) further comprises a closure (50) having a closure part (51) for opening and closing the opening (33) and an operating device (40) for actuating the closure part (51). The closure part (51) is arranged on the lower face (32) so as to be pivotable about a first axis (A) which extends substantially parallel to the lower face (32). The operating device (40) is arranged on the closure part (51) so as to be rotatable about a second axis (B) and be rotatable from a first position ($S_1$) into a second position ($S_2$). The opening (33) can be closed by rotating the operating device (40) into the first position ($S_1$) and can be opened by rotating the operating device (40) into the second position ($S_2$).

31 Claims, 14 Drawing Sheets

Figure 1A:
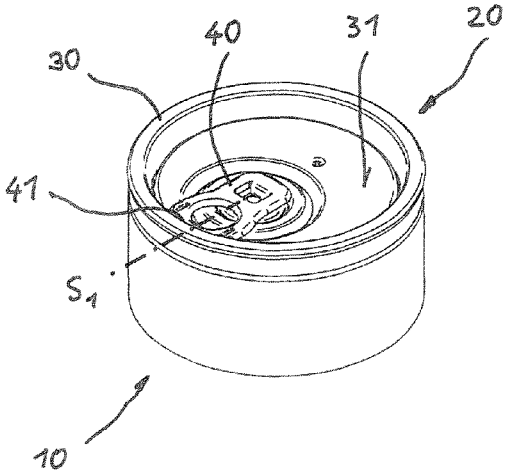

(51) Int. Cl.

| | |
|---|---|
| ***B65D 51/16*** | (2006.01) |
| ***B65D 43/22*** | (2006.01) |
| ***B65D 43/24*** | (2006.01) |
| ***B65D 43/26*** | (2006.01) |

(52) U.S. Cl.
CPC ..... *B65D 45/22* (2013.01); *B65D 51/1683* (2013.01); *B65D 51/1688* (2013.01); *B65D 2205/02* (2013.01)

(56) References Cited

U.S. PATENT DOCUMENTS

| | | | | |
|---|---|---|---|---|
| 4,673,099 | A | 6/1987 | Wells | |
| 4,681,238 | A | 7/1987 | Sanchez | |
| 5,692,633 | A | 12/1997 | Gordon | |
| 6,588,617 | B1 | 7/2003 | Majcen et al. | |
| 6,626,314 | B1 | 9/2003 | McHenry et al. | |
| 7,500,577 | B2 | 3/2009 | Wichelhaus | |
| 8,336,726 | B2 * | 12/2012 | Ramsey et al. | 220/254.3 |
| 8,794,469 | B2 | 8/2014 | Bratsch | |
| 2009/0173737 | A1 | 7/2009 | Ramsey et al. | |
| 2009/0206083 | A1 | 8/2009 | Heigl | |
| 2012/0103987 | A1 | 5/2012 | Lucas | |

FOREIGN PATENT DOCUMENTS

| | | | |
|---|---|---|---|
| DE | 102006051409 | A1 | 4/2008 |
| DE | 10-2008-011919 | A1 | 9/2009 |
| EP | 1247752 | A1 | 10/2002 |
| FR | 2936227 | A1 | 3/2010 |
| GB | 2331284 | | 5/1999 |
| JP | S51-059592 | A | 5/1976 |
| JP | S59-035335 | U | 2/1984 |
| JP | H04-102546 | A | 4/1992 |
| JP | 2004-291990 | A | 10/2004 |
| JP | 2006-510553 | A | 3/2006 |
| WO | 2006/009483 | A2 | 1/2006 |
| WO | 2007-128810 | A1 | 11/2007 |
| WO | 2007/147542 | A1 | 12/2007 |
| WO | 2009062004 | A1 | 5/2009 |
| WO | 2009103817 | | 8/2009 |
| WO | 2011-026993 | A1 | 3/2011 |

OTHER PUBLICATIONS

Chinese Office Action in corresponding Chinese Application No. 201180017325.5 dated Aug. 29, 2014 (12 pages)—See tables on pp. 1 for citations.

English Translation of Search Report for corresponding Japanese Application 2013-503077 of Jan. 23, 2015.

Notice of Opposition for corresponding European Patent EP 2 555 988 with machine translation.

* cited by examiner

CONTAINER CLOSURE DEVICE AND CONTAINER HAVING SUCH A CLOSURE DEVICE

The invention relates to a container closure device for a container, in particular for a beverage can. The container closure device comprises a lid having an upper face, a lower face, and an opening. The container closure device further comprises a closure having a closure part for opening and closing the opening and an operating device for actuating the closure part.

This type of container closure device is known from document WO 2007/147542 A1. The known container closure device has an operating device that is fixedly connected to the lid and is adapted for depressing the closure part by lifting the tab and for lifting the closure part by depressing the tab, in order to reclose the opening. A drawback of this closure device is that for fixing the tab a fixing device is required.

A further container closure device is known from document WO 2009/103817 A1. Said known container closure device comprises a reclosable opening that can be opened by means of an operating device. Said operating device is moved in a direction parallel to the container closure device whereby the closure is pivoted downwards. By moving the operating device in the opposite direction, the closure is pivoted toward the opening which is thus closed.

Generally, if a pressure inside the container is excessively high, the container may have a crowning. Due to that crowning of the container, the container closure device is deformed outwardly. In the last-mentioned known container closure device, the crowning of the container greatly impedes the actuation of the operating device so that the functionality of the container closure device is severely limited.

Further container closure devices are known from U.S. Pat. No. 3,952,914 A, GB 2 331 284 A, and U.S. Pat. No. 6,626,314 B1.

It is an object of the present invention to provide a container closure device with a reclosable closure mechanism which has a simple construction and is easy to operate.

For the solution of this object, a container closure device is proposed which comprises the aforementioned features, wherein the closure part is arranged on the lower face so as to be pivotable about a first axis which extends substantially parallel to the lower face. The operating device is arranged on the closure part so as to be rotatable about a second axis and be rotatable from a first position into a second position. The opening can be closed by rotating the operating device into the first position and can be opened by rotating the operating device into the second position.

The container closure device according to the invention affords a flat design which makes the container closure device perfectly suitable for use in filling machines. The reclosable closing mechanism can be operated easily and intuitively. Rotating the operating device into the second position enables the closure part to be pivoted downwards for opening. If necessary, this can also be done by the operator exerting a pressure on the closure. If the operating device is thereafter returned to the first position, the closure part is automatically moved close to the opening, which is thus reclosed. If an increased pressure exists inside the container, the closure part is urged against the lid as a result of that pressure, whereby the sealing effect occurring between the closure part and the lid is enhanced. For that reason, the container closure device of the invention is also suited for containers which contain a highly pressurized fluid. A further advantage of the container closure device of the invention is that when the container with a liquid contained therein is overthrown the closure part is pressed against the lid due to the weight of the liquid in the container, thus preventing the liquid from leaking from the container.

Within the scope of the present invention, the operating device may also be referred to as an actuating device, the closure part as a closure device or closure means and the opening as a spout or drinking orifice. Further, the first position can be referred to as a closed position and the second position as an opened position. Preferably, the container closure device according to the invention is used for a reclosable can, in particular a reclosable beverage can.

In a preferred embodiment, the second axis extends substantially at right angles to the first axis and/or to the closure part. Further preferably, the second axis extends substantially at right angles to the lid. This construction has the advantage that the operating device can be fully rotated about the second axis and almost parallel to the closure part by an angle having an angular dimension of 360°.

Preferably, the closure part includes a groove and the opening is bordered by a beading which in the closed condition of the closure engages in said groove. This construction contributes to an improved sealing function between the closure and the lid. Moreover, while pressing the closure towards and against the lid for closing the opening, the closure part is automatically aligned or centered. Additionally, the closure which is applied against the lid is prevented from slipping out of place. The beading preferably extends away from the lid upper face and downwards, preferably in a rounded fashion. Thus a drinking orifice is provided which differently from known can openings does not have a sharp tear-open edge and thus prevents a risk of injury.

Preferably, a sealing is provided. Such a sealing affords an improved tightness between the closure and the lid.

In a preferred construction, the sealing is arranged between the lid and the closure part. In a further preferred construction, the sealing is fixed to the closure part or to the lid. Further preferably, the sealing can be provided on the beading and/or in the groove.

In a further preferred construction, the sealing can be formed by a coating. Preferably, the coating is applied to the lower face. This construction has the advantage that during the manufacture the sealing can be rapidly and easily applied to the lower face of the lid, for example by spraying.

In a further preferred construction, the sealing has a sealing lip which in a closed condition of the closure rests on the lower face. The sealing lip can be arranged for example on a lower face of the closure part.

Preferably, the closure comprises a locking mechanism (or snap-fit mechanismus) for locking the closure against and in contact with the lower face. This construction has the advantage that when the container is overthrown, the closure remains applied against the lower face and thus reliably closes the opening.

Preferably, the opening has an approximately oval and, further preferably, an approximately circular shape. Preferably, the sealing has an approximately circular shape. Preferably, the sealing can have a conical shape.

In a preferred construction, the operating device has a first end which upon rotation of the operating device from the first position into the second position is arranged above the upper face. This construction has the advantage that the operating device while being rotated from the first position into the second position can be actuated by a user from outside and remains accessible. On the other hand, a user's access to the operating device would be worse if the operating device were positioned below the lower face or inside the beverage can while it is rotated or after it has been rotated.

In a preferred construction, the opening has a rim and the first end is arranged outside that rim upon rotation of the operating device from the first position into the second position. This construction has the advantage that it is not possible for the operating device being pivoted into the interior of the can totally through the opening so that at least said first end remains accessible to the user.

Preferably, the operating device rests on the upper face. Further preferably, the operating device rests on the upper face while it is pressed against said upper face. These constructions have the advantage that as a result of the lever arm between the fulcrum and the axis of rotation of the operating device the closure part is pulled or pivoted upwards while the operating device is rotated and the closure part in its first position is pressed against the lower face of the lid. In this way, a closure which has been pivoted into the interior of the container can again be pressed against the lid by rotating the operating device.

In a preferred construction, the operating device is rotated about an angle in order to get from the first position into the second position, wherein said angle has an angular dimension of approx 90° to approx 180°, preferably approx 180°. Such a rotation of the operating device can be simply accomplished by using a finger.

Preferably, the operating device is a lever or a tab, in particular a SOT tab. SOT tab (stay on tab) is a technical term which is known to and used by professionals for denoting the operating device that is commonly used in beverage cans.

In a preferred embodiment, the operating device can be fixed by means of a locking device. Thus the operating device can be fixed relative to the lid. Preferably, the locking device is arranged on the upper face. This construction has the advantage that it prevents the container from being opened accidentally or from otherwise opening itself as a result of the operating device being moved during transportation for instance.

In a preferred embodiment, the closure device of the container is characterized by a valve for adjusting the pressure of a fluid contained in said container to ambient pressure. The container closing device of the invention is designed for receiving a fluid at a pressure of up to approx 6 to 7 bar. If a pressure inside the container is that high, the closure will be pressed against the lid from inside to such an extent that the closure can be depressed only with high effort in order to open the container. The valve enables a reduction of that excess pressure inside the can so that the closure can be depressed more easily or flips downwards automatically whereby the container is opened more easily. For example, the valve can be a lifting valve, a check valve or the like.

In a preferred embodiment, the valve is opened by pressing a valve button. Preferably, pressing the valve button causes a blocking body to move into the interior of the can and thus exposing an outlet through which the fluid can escape to the outside. Preferably, the valve is opened by lifting the operating device. Preferably, the operating device serves as a lever which is connected to a locking body that can be displaced into the interior of the can in order to expose an outlet through which the fluid contained in the interior of the container can leave the container.

Preferably, the valve is opened by rotating the operating device. Preferably, the valve is open when the operating device has been rotated into a third position. Preferably, the third position is arranged between the first position and the second position. This construction has the advantage that for moving the operating device from the first position into the second position in order to open the container, the user is automatically required to move the operating device into the third position, which causes the pressure inside the container being adjusted to ambient pressure before the can is opened. Preferably, the third position does not coincide with the second position. Further, if the container is, for example, overthrown and/or if a pressure is built-up in the interior of the container, the closure can be pressed against the lid and the container be thus closed automatically.

Preferably, the valve is disposed on the closure part. Further preferably, the closure part includes a valve opening. Preferably, the operating device in its third position covers the valve opening so as to protect a user against splashes of a fluid in the container. In this construction, a part of the operating device is arranged across from the valve opening. This means that the valve opening is not sealed in an airtight manner thereby. It is merely prevented in this way that the fluid in the container will be ejected vertically from the valve opening and possibly splash against the user when the valve is opened. Preferably, in its third position, the operating device is spaced from the valve opening.

Preferably, the valve includes a valve element that is arranged on the closure part so as to be rotatable. The valve element includes at least one passage and is fixedly connected to the operating device. The valve is open and the pressure adjustment can take place as soon as the passage and the valve opening overlap each other at least partly or are congruent. Preferably, the passage can be formed by at least one hole, further preferably by at least one long hole. This construction allows easy manufacturing of a valve that is designed for being operated by rotating an operating device.

Preferably, the operating device includes a seal, wherein said seal is damaged, preferably distorted, when the closure is opened for the first time and/or when the valve is opened for the first time and/or when the operating device is rotated and/or lifted for the first time. This construction has the advantage that a user is able to verify on the basis of the condition of the seal from the outside whether or not freshness and/or integrity of the content of the container are guaranteed. Preferably, the seal is provided on the second end of the operating device which is arranged diametrically opposite to the first end with respect to the second axis.

In a preferred construction, the closure part at least includes one projection, wherein the seal abuts against or adjoins the at least one projection before the closure is opened or actuated for the first time. Thus the seal is bended when the operating device is rotated. Preferably, the closure part includes two projections that are arranged adjacent to the seal in the direction of rotation.

Further, the closure part can include at least one depression in which the seal is disposed before the closure is opened or actuated for the first time. Preferably, the depression is adapted for bending the seal away from the closure part when the operating device is rotated.

Preferably, the closure comprises a fixing part with which the closure part is arranged on the lower face so as to be pivotable. The fixing part can be formed separately or integrally with the closure part.

Preferably, the fixing part constitutes a joint, in particular a hinge, or the fixing part comprises a joint, in particular a hinge. The joint thus forms the first axis or provides the same. This guarantees that the container can be opened and closed multiple times in a reliable manner by pivoting the closure part.

Preferably, the joint is formed by a thin-walled connecting region, in particular from an elastically flexible material, between the fixing part and the closure part. This allows the joint being designed and manufactured in a reliable manner at low cost.

In a preferred construction, the lid and/or the operating device and/or the closure and/or the valve is made from aluminum. Normally, at least one of the aforementioned elements can also be made from a plastic material. Particularly preferably, all said elements are made from aluminum.

In a preferred embodiment, the fixing part is connected to the lid and/or the closure part by a material-locking connection, e.g., by bonding, soldering or welding. This construction allows the fixing part to be connected to the lid without redesigning the lid for that purpose, i.e. without the lid even more deviating from the standard design. This has the advantage that the lid is based on a standard lid, except for the opening.

Alternatively or additionally, the fixing part is fixed to the lid by at least one rivet. This construction has the advantage that the connection between the fixing part and the lid can be accomplished in a secure, lasting, and heat-resistant manner. This kind of construction additionally achieves a form-locking connection which is particularly heat-resistant.

In a preferred construction, the rivet is formed by the lid. This has the advantage that the closure can be fixed to the lid without using additional parts. Further, a rivet which is formed in the lid has the advantage that the wall formed by the lid remains complete and that no bore must be made in the lid for inserting rivets for fixing the closure. This construction guarantees impermeability of the lid.

In a further preferred construction, the fixing part is connected to the lid and/or to the closure part in a form-locking manner.

Preferably, the fixing part includes a ring, the lid includes a fixing region that is arranged on the lower face along the opening, and the ring is connected to the fixing part in a form-locking manner. This construction offers the advantage that the use of a rivet and the use of a material-locking connection can be dispensed with. A simple and secure connection of the closure part to the lid is thus guaranteed. As a result, the container closure device constructed in this way is particularly heat resistant and adapted for pasteurizing a fluid inside the container without compromising the reliability of the connection between the fixing part and the lid.

In a preferred construction, the fixing region is formed by beading the lid along the opening. Preferably, the fixing region is formed by the previously mentioned beading of the opening. This construction has the advantage that the closure part can be reliably connected to the lid without the addition of a further component.

A container according to the invention, preferably a can and in particular a beverage can, comprises a container closure device of the invention according to one of the claims 1 to 28. The container can have a wall and a bottom, and the lid of the container closure device is fixed to the wall. The wall and the lid are preferably made from aluminum by a deep-drawing process.

The lid of the container closure device according to the invention which is also referred to as shell in the technical domain is preferably made from aluminum. The lid can be provided for neck sizes 200, 202, 206, and 209. The closure or the lid of the opening is preferably provided with a sealing and with an operating device or a restoring tab, wherein said restoring tab is rotatably provided with the valve. Both the lid of the opening and the restoring tab and the valve are preferably made from aluminum. In said reclosable lid a flat opening lid is incorporated. In one construction, the valve can be opened by applying a slight pressure. The opening lid is closed by a slight left or right rotation using the restoring tab.

In a further construction, a flat lid of the opening is provided with a valve, a vent and a conventional tab. By a slight rotation of the conventional tab to the left or to the right or by slightly pressing the conventional tab, the internal pressure of the container or can body can escape. Thereafter, the lid of the opening will open automatically. By a continued rotation of the conventional tab to either side, the lid of the opening can be reclosed. This procedure can be repeated any time.

The container closure device according to the invention has the advantage that the customary lid sizes 200, 202, 206, and 209 can be used. Due to this closure the container can measure up with competing beverage containers insofar as en-route convenience is concerned. As the lid is made from aluminum it is 100% recyclable. The discharge quantity of the fluid inside the container can be determined by the mouth angle, and its content is completely discharged. If the container or the beverage can are not closed after drinking or are overthrown by their improper handling, the lid will close automatically. The lid seals hermetically even at small liquid quantities and is suited for any cold fillings up to an internal pressure of 6.2 bar. Machine modifications on the manufacturer's side are not required.

Figure 1B:
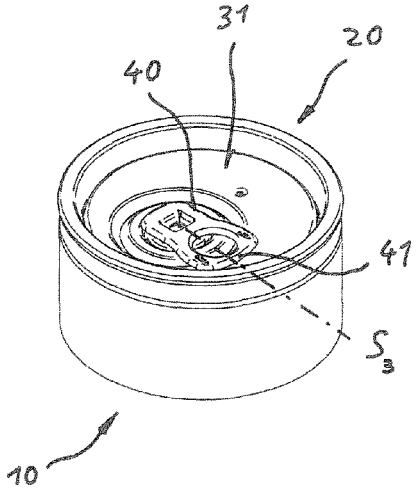
Figure 1C:
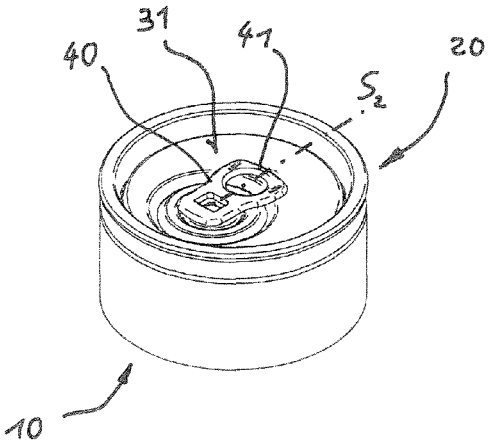
Figure 1D:
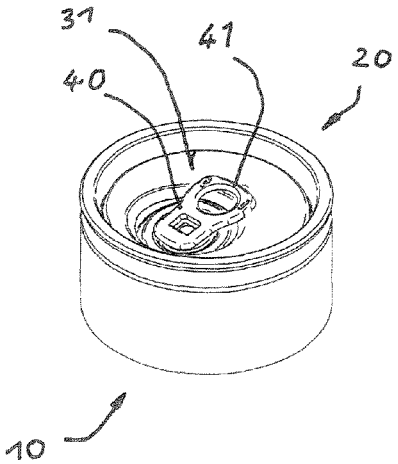
Figure 2:
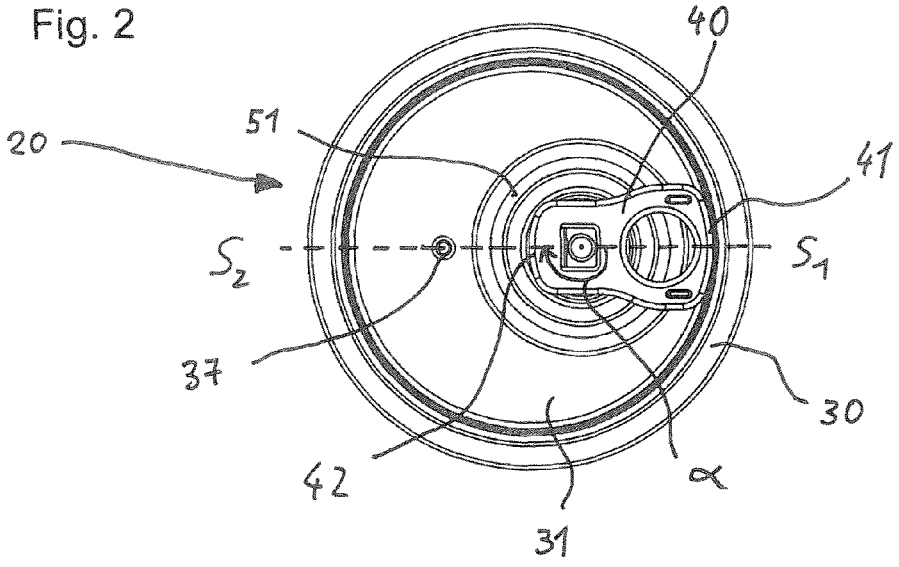
Figure 3:
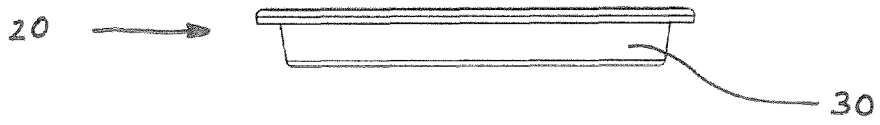
Figure 4:
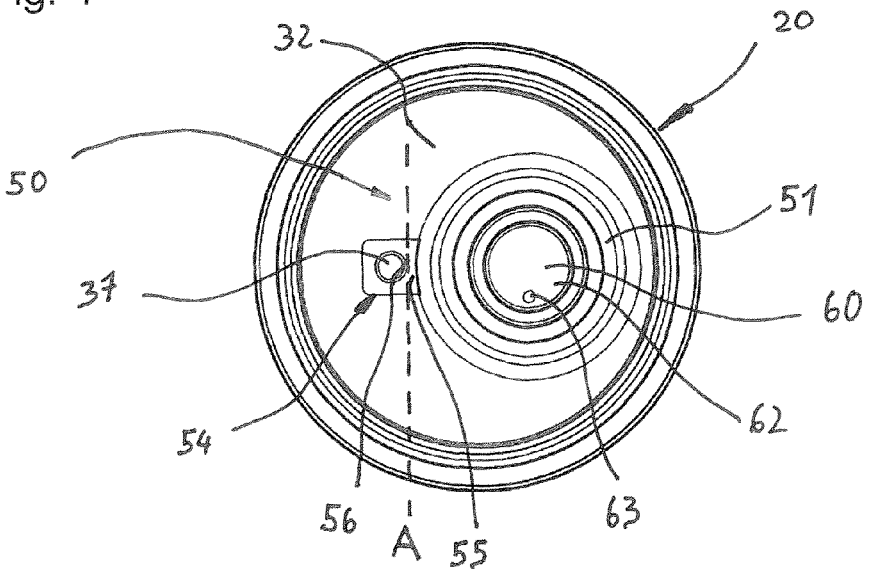
Figure 5:
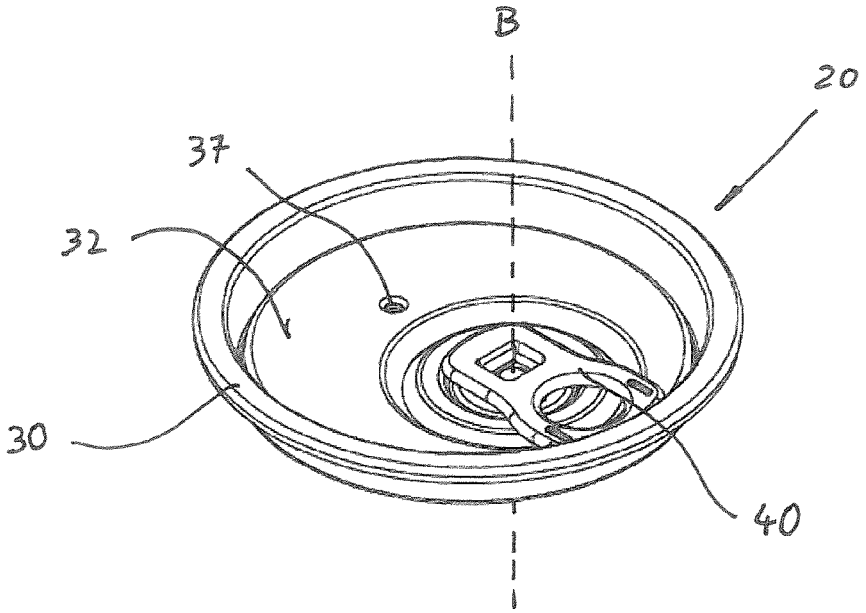
Figure 6:
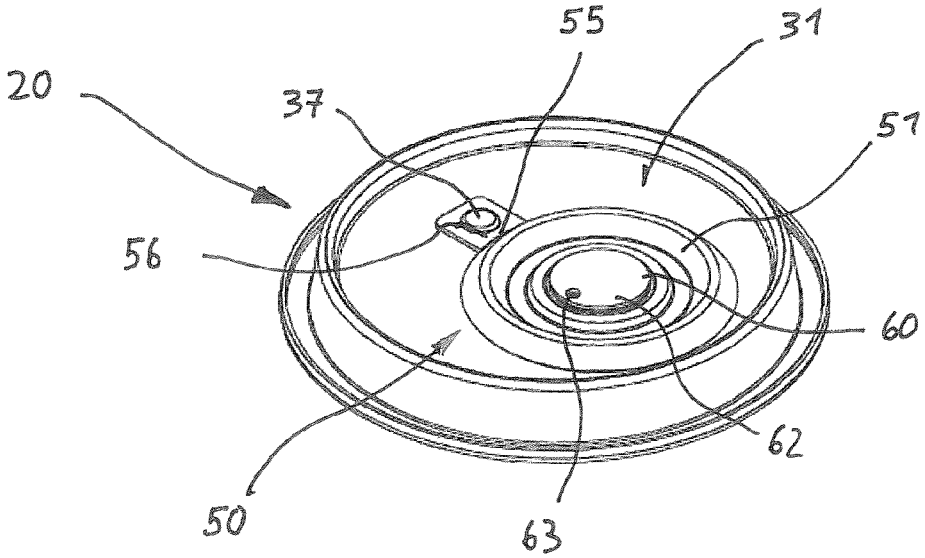
Figure 7:
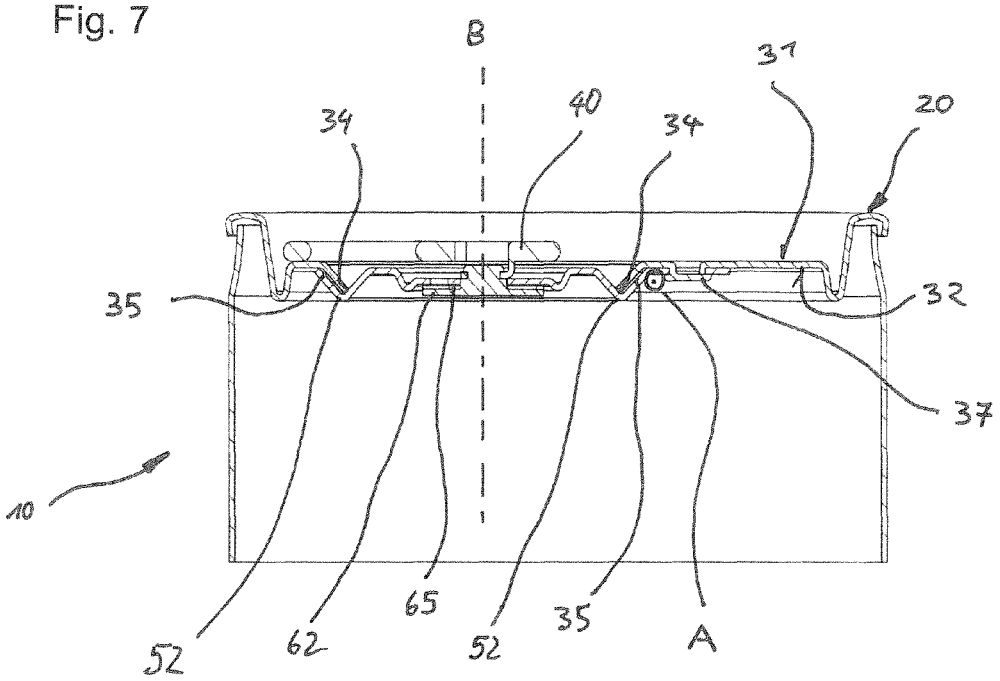
Figure 8:
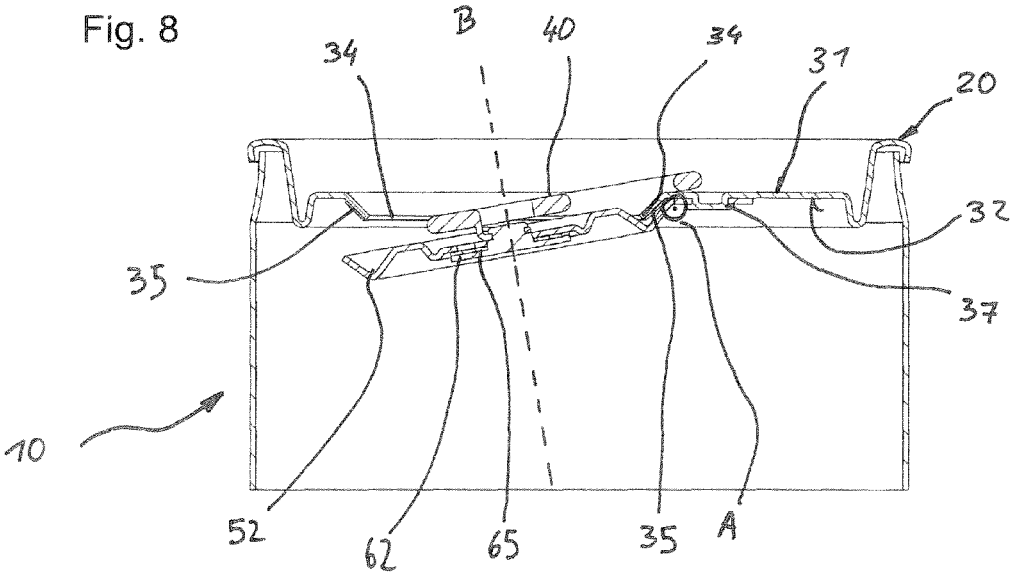
Figure 9:
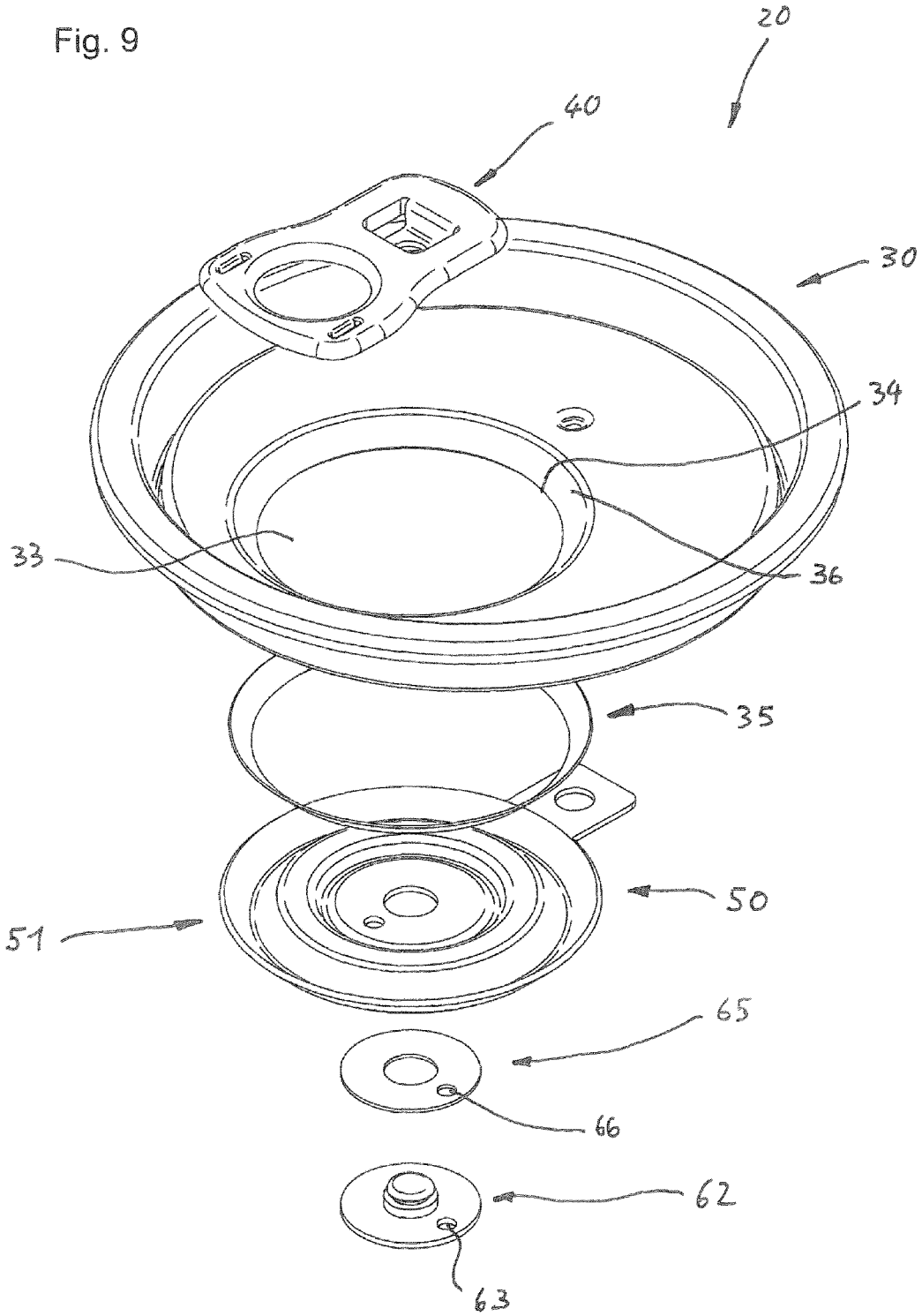
Figure 10:
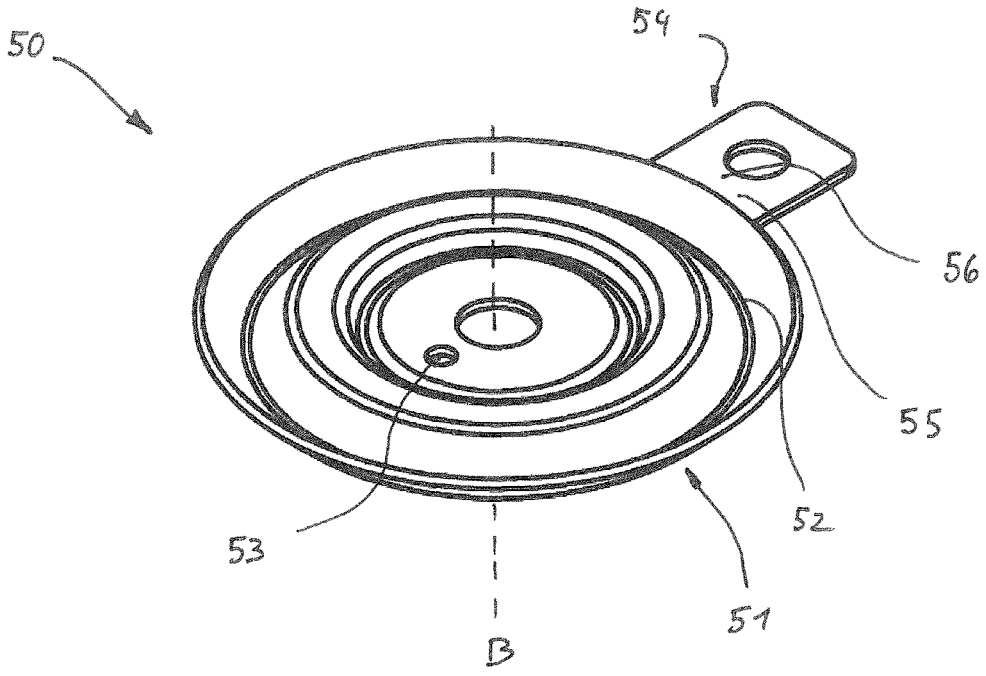
Figure 11:
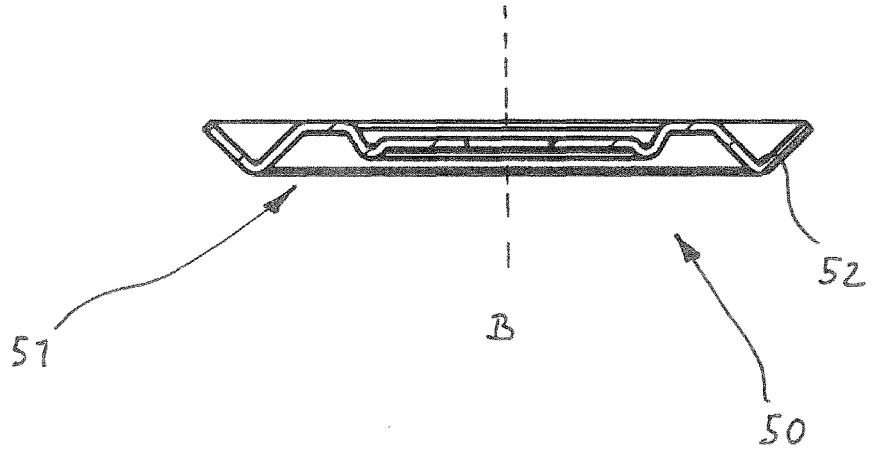
Figure 12:
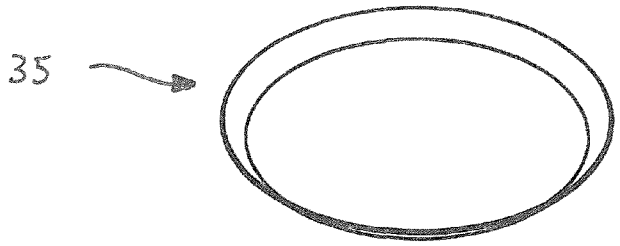
Figure 13:
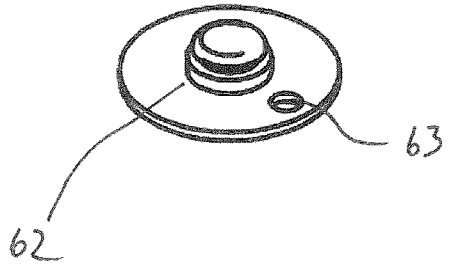
Figure 14:
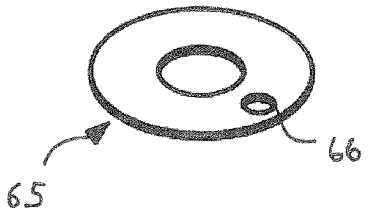
Figure 15:
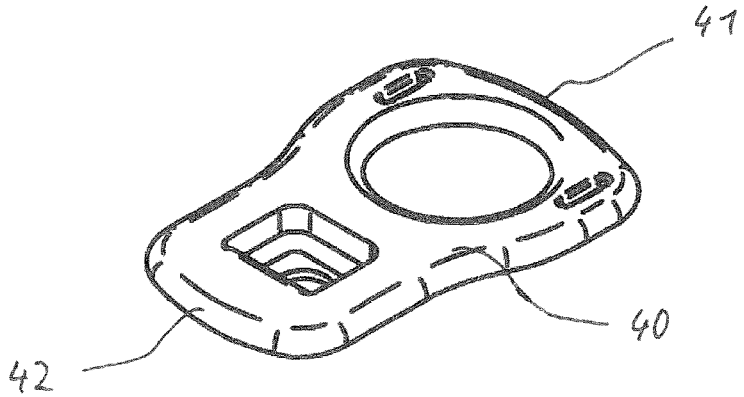
Figure 16:
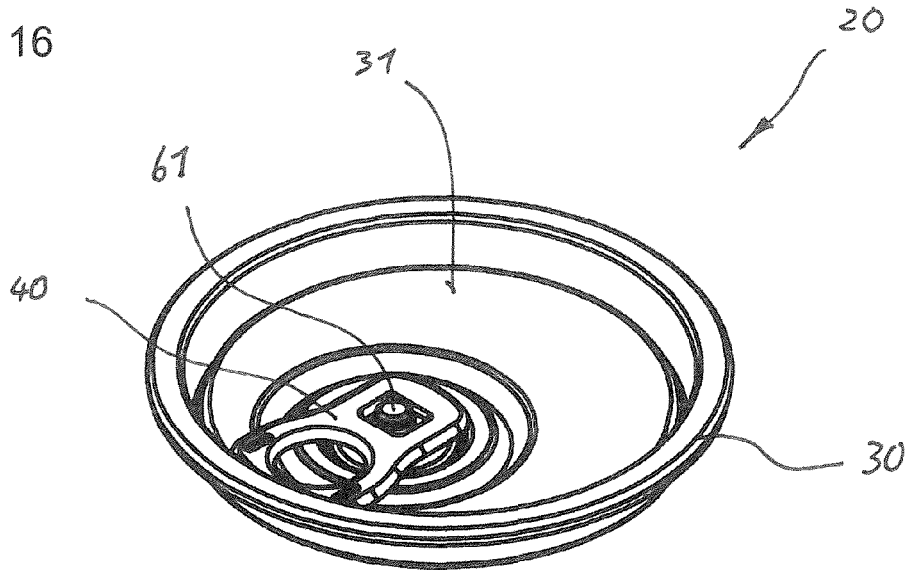
Figure 17:
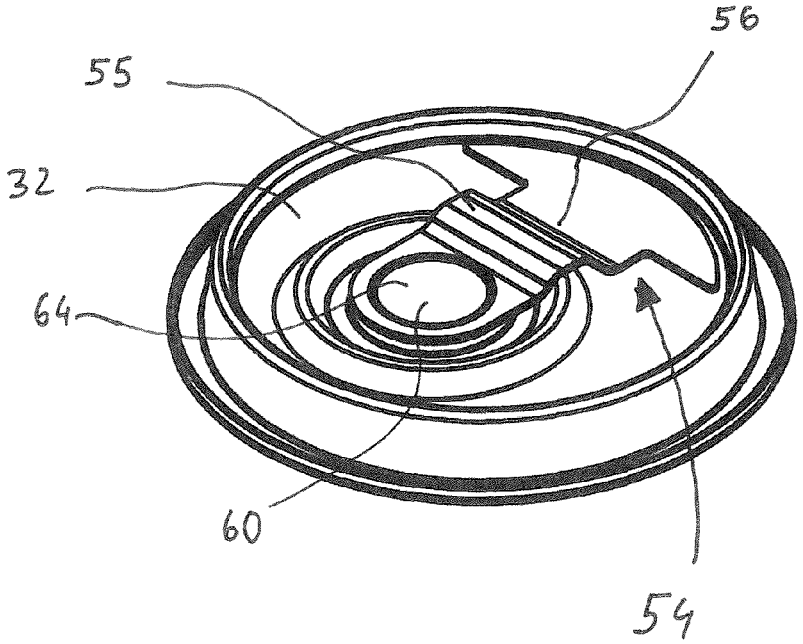
Figure 18:
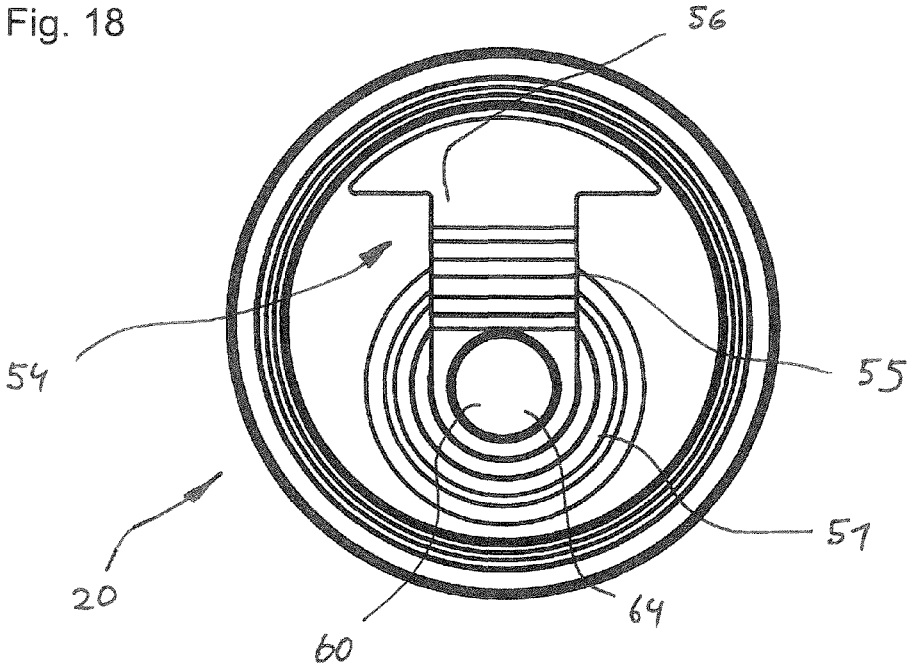
Figure 19:
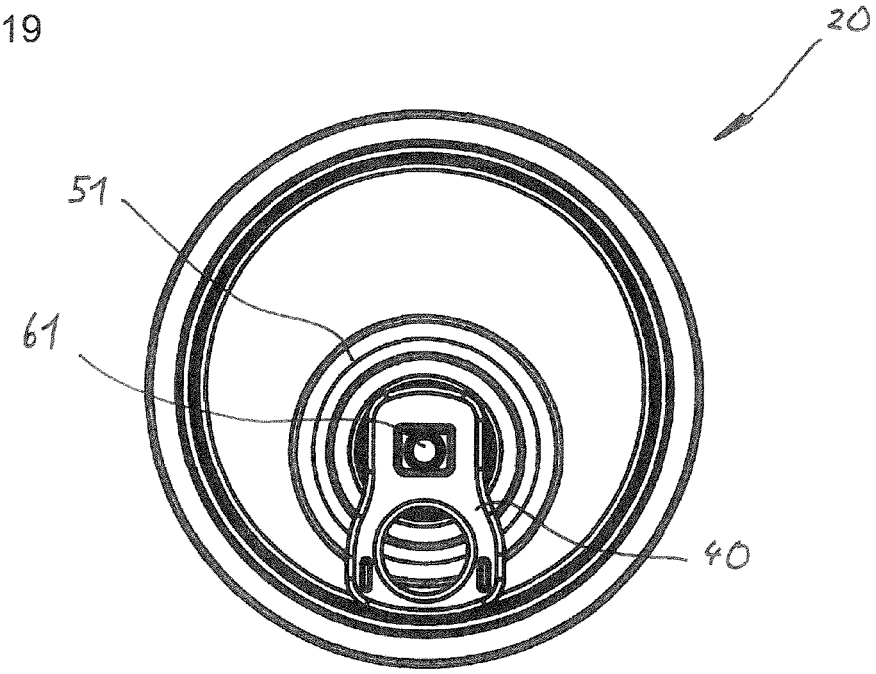
Figure 20:
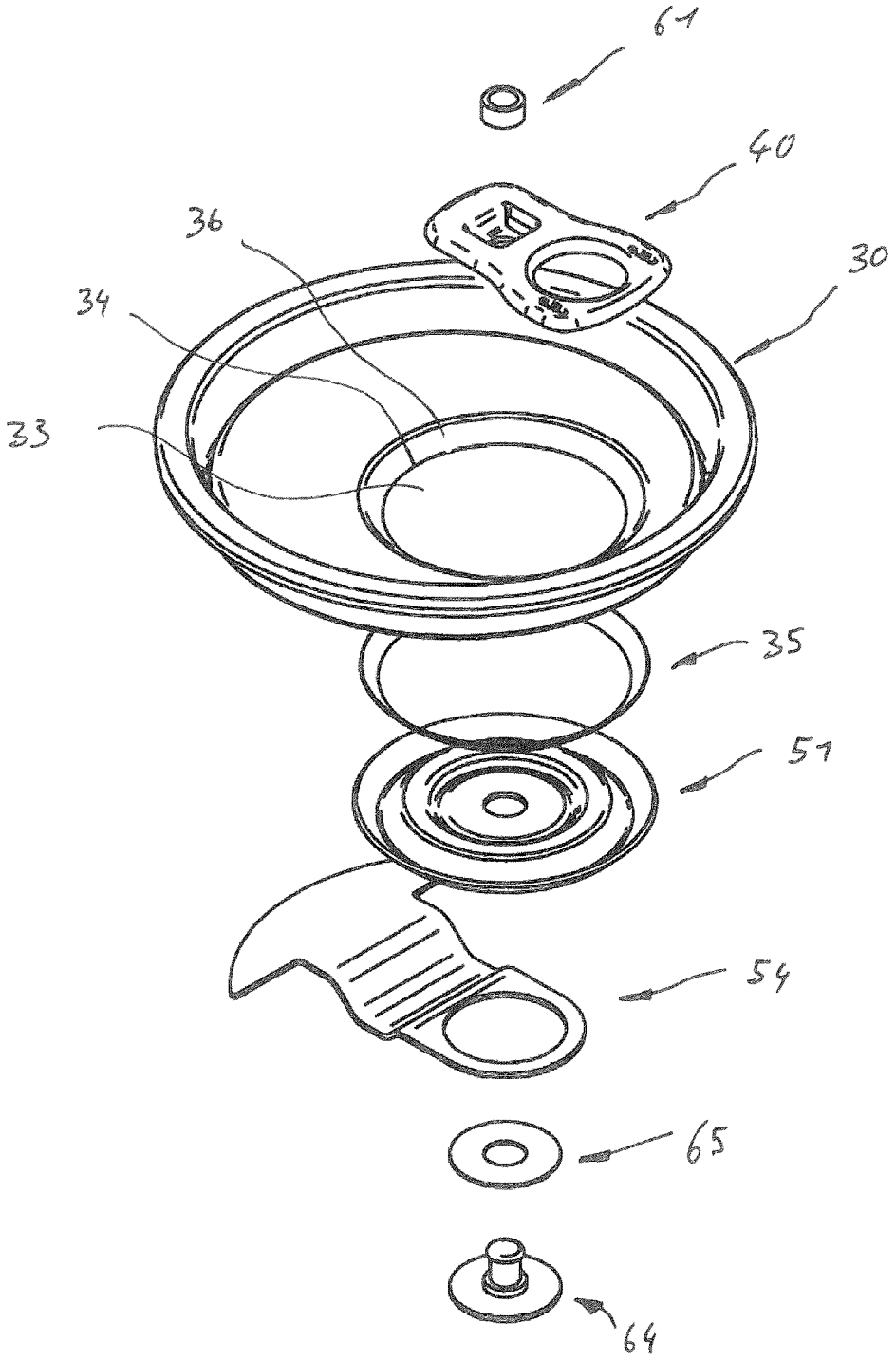
Figure 21:
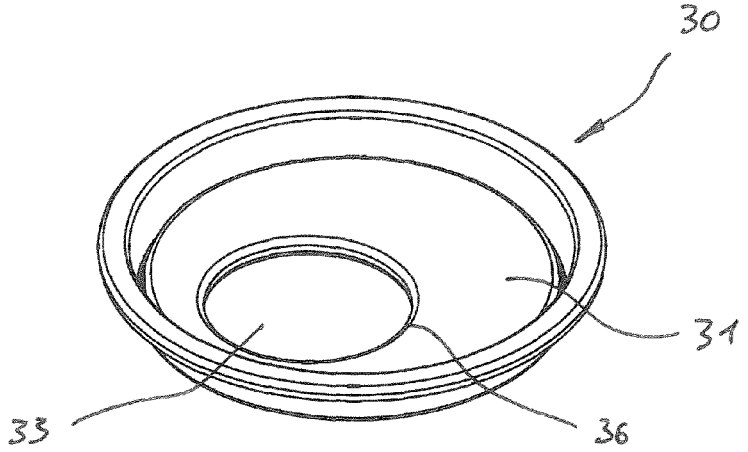
Figure 22:
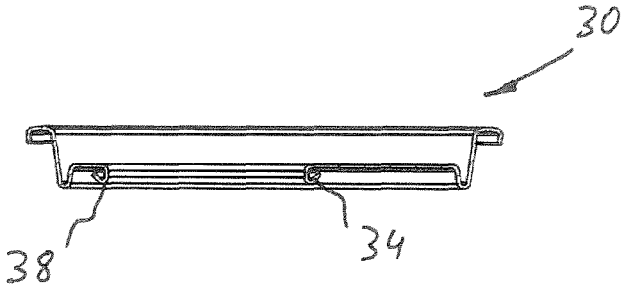
Figure 23:
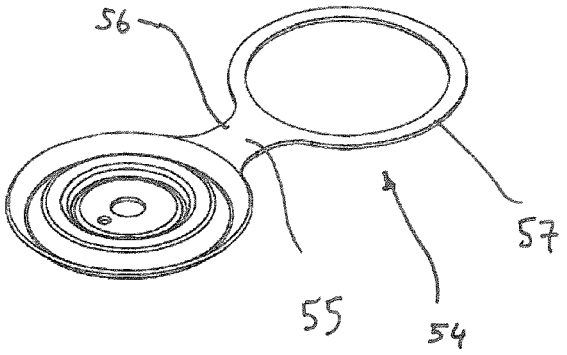
Figure 24:
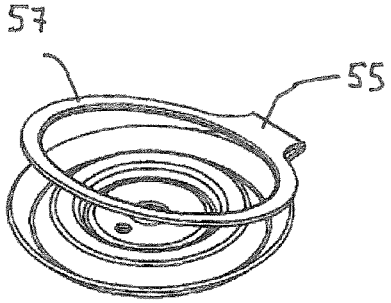
Figure 25:
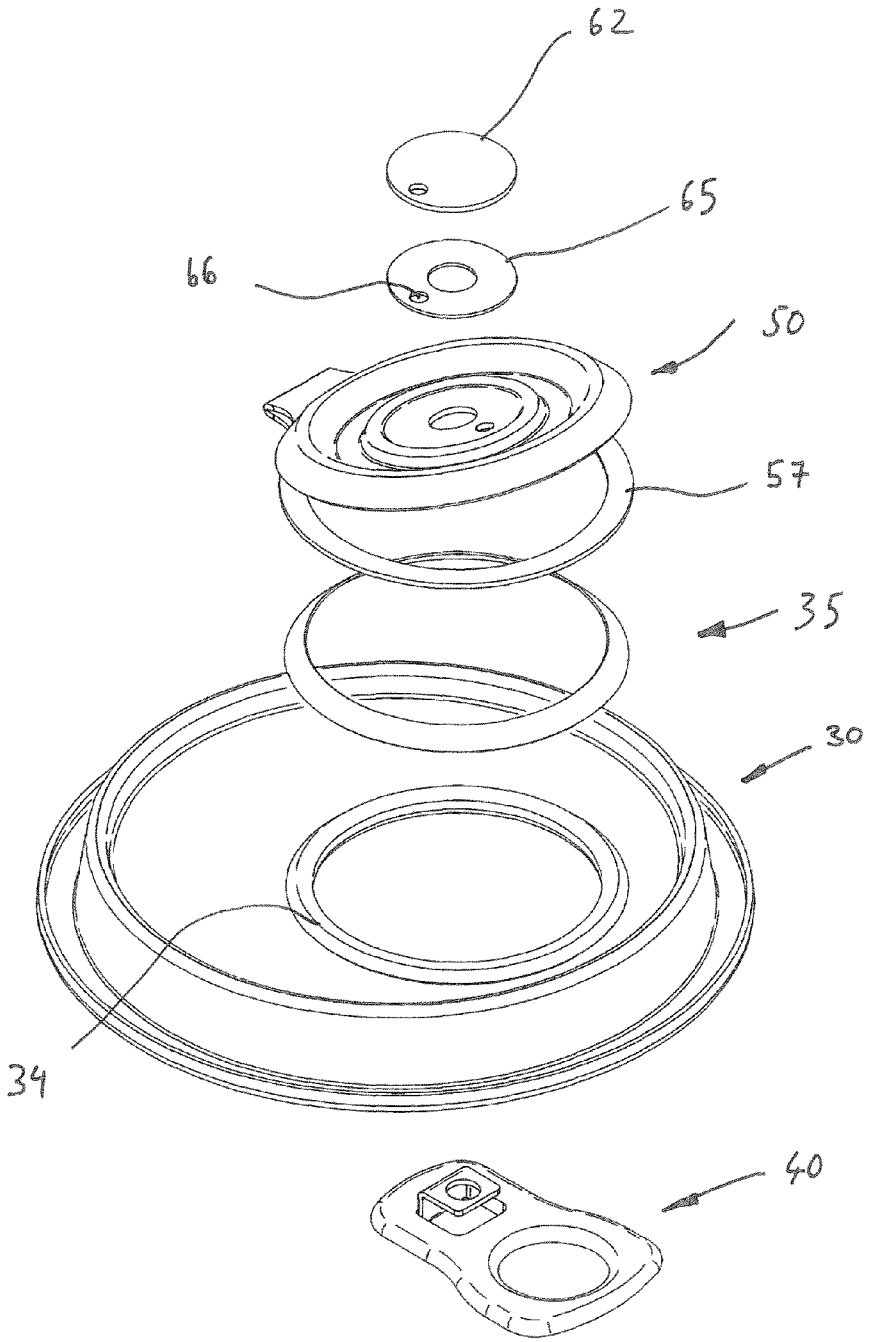
Figure 26:
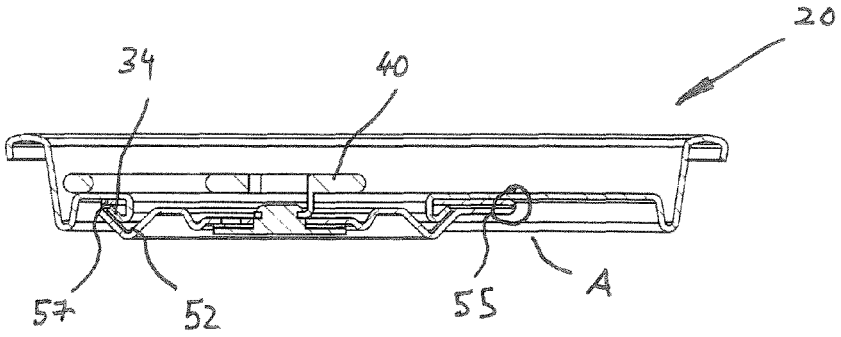
Figure 27:
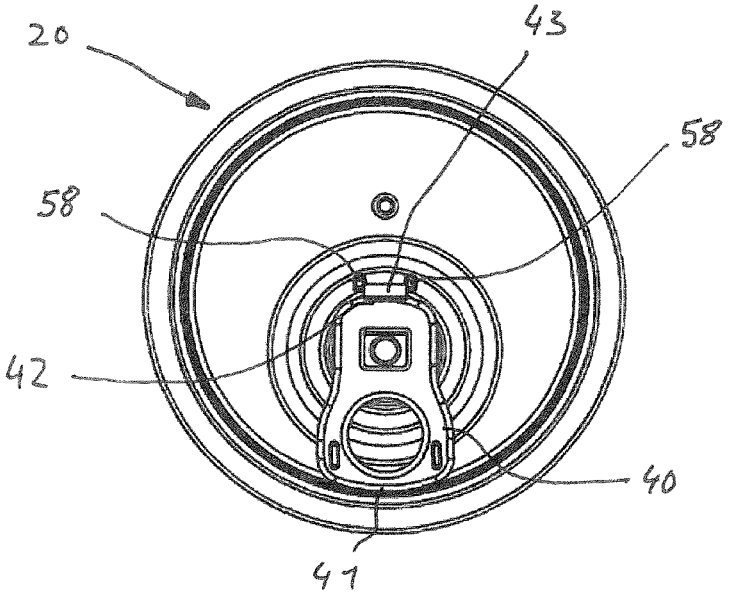
Figure 28:
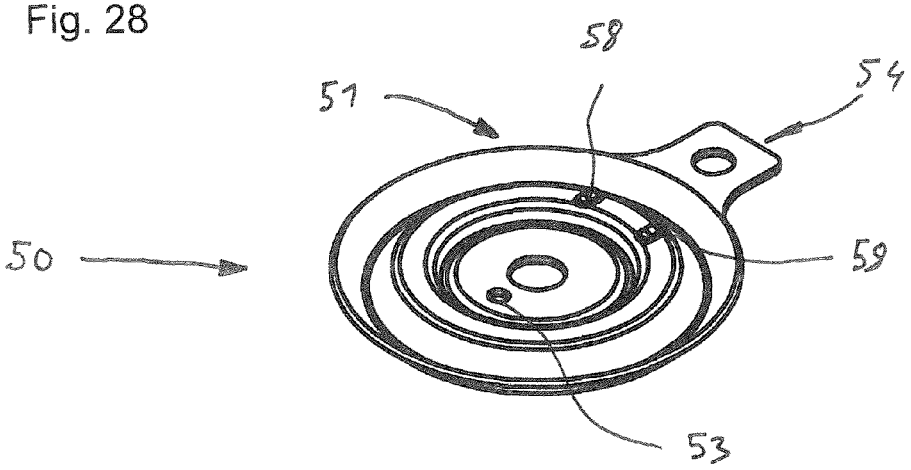
Figure 29:
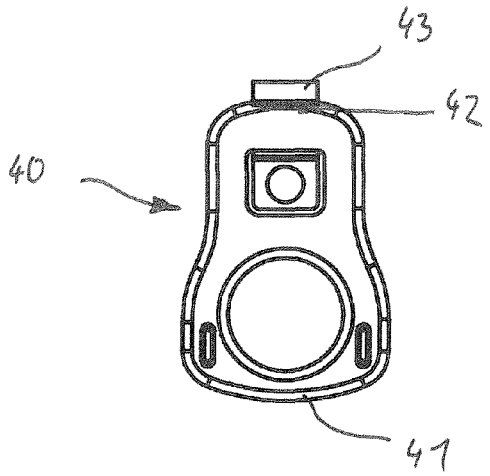
Figure 30:
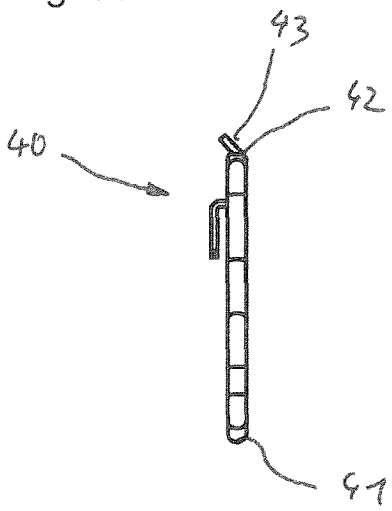
Figure 31:
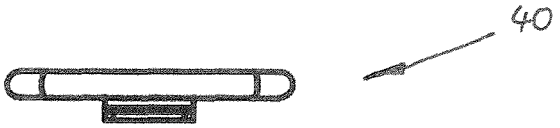
Figure 32:
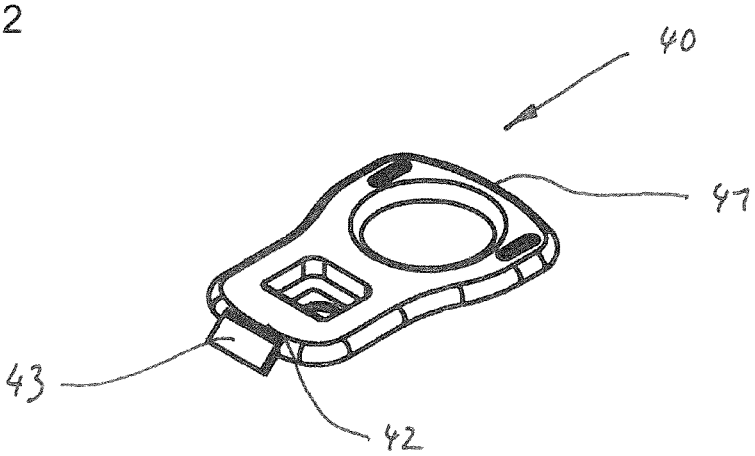

Further details and advantages of the container closure device according to the invention will become apparent from the following description of preferred embodiments which are merely schematically illustrated by the attached drawings wherein it is shown by:

FIG. 1*a* a schematic view of a container of the invention, comprising a container closure device according to a first embodiment of the invention, wherein an operating device is arranged in a first position;

FIG. 1*b* a schematic view of the container according to the first embodiment of the invention, wherein the operating device is arranged in a third position;

FIG. 1*c* a schematic view of the container according to the first embodiment of the invention, wherein the operating device is arranged in a second position;

FIG. 1*d* the container according to the first embodiment of the invention, with a closure in an opened condition;

FIG. 2 a top view of the container closure device according to the first embodiment of the invention;

FIG. 3 a lateral view of the container closure device according to the first embodiment of the invention;

FIG. 4 a bottom view of the container closure device according to the first embodiment of the invention;

FIG. 5 a schematic view of the container closure device according to the first embodiment of the invention;

FIG. 6 a further schematic view of the container closure device according to the first embodiment of the invention;

FIG. 7 a cross-sectional view of the container closure device according to the first embodiment of the invention, in the closed condition;

FIG. 8 a cross-sectional view of the container closure device according to the first embodiment of the invention, in the opened condition;

FIG. 9 an exploded view of the container closure device according to the first embodiment of the invention;

FIG. 10 a schematic view of the closure of the first embodiment;

FIG. 11 a cross-sectional view of the closure of the first embodiment;

FIG. 12 a schematic view of a sealing according to the first embodiment;

FIG. 13 a schematic view of a valve element according to the first embodiment;

FIG. 14 a schematic view of a valve disc according to the first embodiment;

FIG. 15 a schematic view of the operating device according to the first embodiment;

FIG. 16 a schematic view of the container closure device according to a second embodiment of the invention;

FIG. 17 a further schematic view of the container closure device according to the second embodiment of the invention;

FIG. 18 a bottom view of the container closure device according to the second embodiment of the invention;

FIG. 19 a top view of the container closure device according to the second embodiment of the invention;

FIG. 20 an exploded view of the container closure device according to the second embodiment of the invention;

FIG. 21 a lid of the container closure device according to a third embodiment of the invention;

FIG. 22 a cross section through the lid of the container closure device according to the third embodiment of the invention;

FIG. 23 a schematic view of the closure of the of the container closure device according to the third embodiment of the invention;

FIG. 24 a further view of the closure of the container closure device according to the third embodiment of the invention;

FIG. 25 an exploded view of the container closure device according to the third embodiment of the invention;

FIG. 26 a cross-sectional view of the container closure device according to the third embodiment of the invention;

FIG. 27 a top view of the container closure device according to a fourth embodiment of the invention;

FIG. 28 a schematic view of a closure part of the container closure device according to the fourth embodiment of the invention;

FIG. 29 a schematic view of the operating device of the container according to the fourth embodiment of the invention;

FIG. 30 a lateral view of the operating element of the container closure device according to the fourth embodiment of the invention;

FIG. 31 a further lateral view of the operating element of the container closure device according to the fourth embodiment of the invention;

FIG. 32 a further schematic view of the operating element of the container closure device according to the fourth embodiment of the invention.

The container 10 in a first embodiment of the invention comprises a container closure device 20 according to the invention. The container closure device 20 comprises a lid 30, a closure 50 having an operating device 40 and a valve 60. The lid 30 has an upper face 31, a lower face 32 and an opening 33. Preferably, the opening 33 is approximately circular. The closure 50 is fixed to the lower face 32 of the lid 30 and covers the opening 33 from the lower face 32 with a closure part 51. In the closed condition, the closure part 51 extends substantially parallel to the lower face 32 and is arranged for pivoting about a first axis A. The first axis A substantially extends parallel to the lower face 32 or to the lid 30.

Preferably, the operating device 40 is designed as a tab and is arranged on the closure part 51 in such a manner that it can be rotated about a second axis B. By its rotation about the second axis B, the operating device 40 can be moved to different positions $S_1$, $S_2$, $S_3$.

FIG. 1*a* shows the container 10 with a container closure device 20, wherein the operating device 40 is arranged in a first position $S_1$. The container which is illustrated in FIG. 1*b* comprises the operating device 40 that is arranged in the third position $S_3$. FIG. 1*c* shows the container 10 according to the invention with the operating device 40 in a second position $S_2$. In the first position $S_1$, the container 10 is closed by the closure part 51 lying against the opening 33 from the lower face 32 of the lid 30. Here the operating device 40 in the first position $S_1$ serves as a lever, which allows the closure part to be pivoted into the interior of the container about the first axis A. The container 10 is thus closed.

In FIG. 1*c*, the operating device 40 is arranged in the second position $S_2$. The latch which is formed by the operating device 40 is released and the operating device 40 does no longer form an obstacle to the pivoting movement of the closure part 51 about the first axis A. The container can thus be opened as indicated in FIG. 1*d*.

FIG. 1*b* shows the container with the operating device 40 in the third position $S_3$. In a preferred construction, an operating device 40 that has been moved to the third position $S_3$, opens a valve 60 for allowing a pressure to escape from the interior of the container 10.

In each of the positions $S_1$, $S_2$, $S_3$, the operating device 40 is arranged above the upper face 31 of the lid 30. Moreover, the operating device 40 rests on the upper face 31 at least partially. The operating device 40 has a first end 41 which is arranged outside the rim 36 of the opening 33, irrespective of the position $S_1$, $S_2$, $S_3$ in which the operating device 40 is arranged.

As can be seen particularly in FIG. 2, the operating device 40 is arranged in such a manner that it can be rotated about the second axis B. An angle formed between the first position $S_1$ and the second position $S_2$ corresponds to approx 180° in the preferred embodiment. As can be seen particularly in the top view of the container closure device 10 of the first embodiment in FIG. 2, a rivet 37 formed in the lid 30 is provided also from the upper face 31, and the closure 50 with its fixing part 54 is connected to the lid 30 with the aid of said rivet.

A view from below of the container closure device 10 in the first embodiment is shown in FIG. 4. This view illustrates how the fixing part 54 of the closure 50 is fixed to the rivet 37. The closure 50 can be pivoted about the first axis A by means of a joint 55. The joint 55 is arranged along the first axis A. A connecting region 56 is arranged on the fixing part 54 between the joint 55 and the closure part 51. The fixing part 54 according to the first embodiment has an approximately rectangular cross section. The fixing part 54 has a rivet hole through which the rivet 37 is driven.

The valve 60 of the container closure device 10 according to the first embodiment of the invention is arranged substantially in the center of the closure part 51. As can be seen particularly in FIG. 10, the closure part 51 in the first embodiment includes a valve opening 53. The valve 60 has a valve element 62 which is arranged on the closure part 51 so as to be rotatable and is rigidly connected to the operating device 40 so that by rotating the operating device 40 about the second axis B also the valve part 62 is rotated about the second axis B. Preferably, a valve disc 65 is disposed between the valve element 62 and the closure part 51. The valve disc 65 can be designed as a valve sealing, made for example from rubber or metal, in particular aluminum. Preferably, the valve disc 65 includes an opening 66. The valve 60 is opened when a passage 63 which is provided in the valve element 62, the valve opening 53 and the opening 66 are congruent or at least partially congruent. Alternatively, the opening 66 and/or the valve opening 53 and/or the passage 63 can be designed as a long hole (elongated hole).

As can be seen particularly in the FIGS. 10 and 11, the closure part 51 of the container closure device 20 has a groove 52 which substantially extends rotation-symmetrically with respect to the second axis B. The groove 52 has a substantially V-shaped cross section and is adapted for receiving a beading 34 of the lid 30 in the closed condition. On the beading 34 a sealing 35 can be arranged. The sealing 35 is preferably fixed to the lid 30. Alternatively, the sealing 35 can be fixed to the closure part 51 or between the closure part 51 and the lid 30.

As can be seen particularly in the FIGS. 7 and 8, the first axis A is arranged on the lower face 32 of the lid 30 adjacent to the beading 34 and extends parallel to the lid 30. In the FIGS. 7 and 8, the first axis A extends at right angles to the plane of projection. The second axis B extends parallel to the plane of projection and approximately through the center of the closure part 51. Along the second axis B the valve element 62 is arranged. In FIG. 7, the operating element 40 is arranged in the first position $S_1$ and the opening 33 of the lid 30 is closed by the closure part 51. The sealing 35 is disposed between the closure part 51 and the beading 34 and is fixed to the beading 34. The lid 30 is integrally formed also in the region of the rivet 37. The rivet 37 is formed by the wall of the lid 30. FIG. 8 shows the container 10 in an opened condition. The closure part 51 is pivoted downwards about the axis A thus allowing a fluid to be discharged from the opening 33. The operating device 40 rests on the upper face 31 of the lid 30 and is arranged in the second position $S_2$. By rotating the operating device 40 into the first position $S_1$, the container 10 can be restored from its opened condition illustrated in FIG. 8 to its closed position illustrated in FIG. 7.

As can be seen particularly in FIG. 9, the sealing 35 is disposed between the lid 30 and the closure part 51. The opening 33 is formed by a beading 34. The beading 34 forms a rim 36. As particularly shown in FIG. 12, the sealing 35 is approximately circular and in particular conical. The sealing 35 is adapted for being rested on the beading 34 and for sealing the closure 50 against the lid.

FIG. 15 illustrates an operating device 40 of the container closure device. According to the first embodiment of the invention, said operating device 40 can be a tab or a standard SOT tab. The operating device 40 has a first end 41 and a second end 42 arranged oppositely to the first end 41 with respect to the second axis B. Preferably, the second end is arranged within the rim 36 of the opening 33 and does not rest on the upper face 31 of the lid 30.

The FIGS. 16 to 20 illustrate a second embodiment of the container closure device 20 according to the invention. In that second embodiment, the closure part 51 is connected to the lid 30 by means of an alternatively designed fixing part 54. In this construction, the provision of a rivet 37 in the lid 30 can be omitted. The connecting region 56 matches the contours of the lid 30. One end of the connecting region 56 rests on the lower face 32 of the lid 30 over its full area and is connected thereto preferably by a material-locking connection. The material-locking connection can be accomplished by bonding or alternatively by welding or soldering. The joint 55 is disposed between the connecting region 56 and the closure part 51. The fixing part 54 according to the second embodiment is made from e.g. a thin-walled aluminum sheet metal. Preferably, also the connection between the closure part 51 and the fixing part 54 is a material-locking connection. This material-locking connection can be an adhesive connection, a welded and/or soldered connection.

In the second embodiment, however, the operating device 40 is not rigidly connected to the valve element 62. Instead a valve head 61 is arranged substantially in the center of the closure part 51, which valve head is connected to a locking body 64. The valve head 61 and the locking body 64 are arranged substantially rotation-symmetrically with respect to the second axis B and along the second axis B. The valve head 61 can be operated from outside of the container 10.

By pressing the valve head 61, the locking body 64 is moved downwards, i.e. in the direction of the interior of the container 10. By pressing the valve head 61 and by moving the locking body 64 downwards, an outlet is formed that is particularly suited for discharging pressure from the interior of the container 10 to the environment.

In the third embodiment which is illustrated in the FIGS. 21 to 26, the container closured device 20 is characterized by the fixing part 54 having a ring 57 and the lid 30 having a fixing region 38, which is arranged on the lower face 32 and is preferably formed by a beading 34. The ring 57 is connected to the fixing region 38 in a form-locking manner. In the same manner as the lid 30 according to the second embodiment, the lid 30 according to the third embodiment, which is shown in FIG. 21, does not include a rivet 37. The form-locking connection of the ring 57 and the fixing region 38 enables a reliable and inexpensive connection between the closure 50 and the lid 30. As can be seen particularly in FIG. 22, the fixing region 38 is formed by a beading 34. The beading 34 is formed on the lower face 32 of the lid along the opening 33.

As can be seen particularly in the FIGS. 23 and 24, the closure 50 according to the third embodiment is characterized by an alternative construction of the fixing part 54. The fixing part 54 includes a ring 57 and a connecting region 56. The joint 55 is formed by turning down the fixing part 54. The closure 50, in particular the fixing part 54 and the joint 55, is formed by an elastically flexible material. For fixing the closure 50 to the lid 30, the ring 57 is, as illustrated particularly in FIG. 25, put over the beading 34 and locked against the beading 34 after the sealing 35 has been attached. The closure part 51 is now arranged along the joint 55 in such a manner that it can be pivoted about the first axis A.

As can be seen particularly in FIG. 26, the first axis A on the lower face 32 is formed by the joint 55. The position of the first axis A can be changed by varying the distance between the ring 57 and the closure part 51 in the flipped-open condition of the closure 50. In the installed condition of the closure 50 as shown in FIG. 26, both the connecting region 56 and the closure part 51 and the lid 30 are arranged parallel to each other.

The FIGS. 27 to 32 illustrate a container closure device 20 according to a fourth embodiment. In this embodiment, two projections 58 are formed on the closure part 51. The operating device 41 comprises a seal 43 which in the first position S1 between said projections 58 is substantially rectangular and rests by one edge on the closure part 51. Alternatively, the seal 43 can also rest on the closure part in a depression that is formed in said closure part 51. For example, the depression can be formed in a region that approximately corresponds to the region between the two reference numbers 58. If the operating device 40 is rotated away from the first position S1, the seal 43 will lift off from the closure part 51, is bended and/or breaks away and thus indicates to the user that the operating device 40 has already been moved so that the integrity of the contents of the container 10 is no longer guaranteed.

Preferably, the seal 53 is arranged on the second end 42. As can be seen particularly in the FIGS. 29 to 32, the seal 43 is arranged so as to be out of square (skew) with respect to the plane in which the lid 30 is arranged. As can be seen particularly in FIG. 30, the seal 43 extends from the second end 42 to the upper face of the closure part 51.

LIST OF REFERENCE NUMBERS

10 container
20 container closure device
30 lid
31 upper face
32 lower face
33 opening
34 beading
35 sealing
36 rim
37 rivet
38 fixing region
40 operating device
41 first end
42 second end
43 seal
50 closure
51 closure part
52 groove
53 valve opening
54 fixing part
55 joint
56 connecting region
57 ring
58 projection
60 valve
61 valve button
62 valve element
63 passage
64 locking body
65 valve disc
66 opening
A first axis
B second axis
$S_1$ first position
$S_2$ second position
$S_3$ third position
angle

The invention claimed is:

1. A container closure device for a container, in particular for a beverage can, comprising:

a lid having an upper face, a lower face, and an opening;

a closure having a closure part for opening and reclosing the opening and an operating device for actuating the closure part;

the closure part being arranged on the lower face so as to be pivotable about a first axis extending substantially parallel to the lower face;

the operating device being arranged on the closure part so as to be rotatable with respect to the closure part about a second axis from a first position to a second position;

wherein the opening can be opened by rotating the operating device with respect to the closure part about the second axis into the second position at which the closure part is moveable out of a sealing engagement with the opening and can be reclosed by rotating the operating device with respect to the closure part about the second axis into the first position at which the closure part is returned into the sealing engagement with the opening, the operating device being pivotable together with the closure part about the first axis, the operating device being rotatable with respect to the closure part about the second axis between the first and second positions while remaining substantially parallel to the closure part, and the closure part being arranged to support rotation of the operating device about the second axis between the first and second positions without the closure part itself rotating about the second axis.

2. The container closure device according to claim 1, wherein the second axis extends substantially at right angles relative to at least one of the first axis and the closure part.

3. The container closure device according to claim 1, wherein the closure part includes a groove and the opening is bordered by a beading that engages in the groove when the closure is closed.

4. The container closure device according to claim 1, further comprising a sealing.

5. The container closure device according to claim 4, wherein the sealing is fixed to one of the closure part and the lid.

6. The container closure device according to claim 4, wherein the sealing includes a sealing lip which rests on the lower face when the closure is closed.

7. The container closure device according to claim 1, wherein the operating device has a first end which is arranged above the upper face upon a rotation of the operating device from the first position into the second position.

8. The container closure device according to claim 7, wherein the opening has a rim, wherein the first end upon a rotation of the operating device from the first position into the second position is arranged outside the rim.

9. The container closure device according to claim 1, wherein the operating device rests on the upper face.

10. The container closure device according to claim 1, wherein the operating device is rotated by an angle between about 90 degrees to about 180 degrees to get from the first position to the second position.

11. The container closure device according to claim 1, further comprising a valve for adjusting the pressure of a fluid in the container to ambient pressure.

12. The container closure device according to claim 11, wherein the valve is opened by lifting the operating device.

13. The container closure device according to claim 11, wherein the valve is opened by pressing a valve button.

14. The container closure device according to claim 11, wherein the valve is opened by rotating the operating device.

15. The container closure device according to claim 14, wherein the valve is opened when the operating device is rotated into a third position.

16. The container closure device according to claim 15, wherein the third position is arranged rotationally between the first position and the second position.

17. The container closure device according to claim 11, wherein the valve is arranged on the closure part (51).

18. The container closure device according to claim 11, wherein the closure part includes at least one valve opening.

19. The container closure device according to claim 11, wherein the valve includes a valve element which is arranged on the closure part so as to be rotatable, wherein said valve element includes at least one passage and is fixedly connected to the operating device.

20. The container closure device according to claim 1, wherein the closure comprises a fixing part including a fixing region fixed to the lower face of the lid through which the closure part is supported from the lower face of the lid.

21. The container closure device according to claim 20, wherein the fixing part includes a joint between the fixing region and the closure part and the joint provides the first axis in a position along the lower face of the lid adjacent to the opening of the lid.

22. The container closure device according to claim 20, wherein the fixing part is connected to at least one of the lid and the closure part in a form-locking manner.

23. The container closure device according to claim 20, wherein the fixing part includes a ring and the lid includes a fixing region that is arranged on the lower face along the opening, and the ring is connected to the fixing region in a form-locking manner.

24. The container closure device according to claim 23, wherein the fixing region is formed by beading the lid along the opening.

25. A container comprising the container closure device according to claim 1.

26. The container according to claim 25 wherein the container is a beverage can.

27. The container closure device according to claim 1, wherein the operating device is arranged as a tab.

28. The container closure device according to claim 27, wherein the opening can be opened in the second position by pivoting the tab together with the closure part about the first axis in a direction toward an interior of the container, and the opening can be reclosed in the first position by rotating the tab with respect to the closure part about the second axis into the first position with the tab being thereby moved into contact with the upper face of the lid for pulling the closure part about the first axis into sealing engagement with the opening.

29. A container closure device for a container, in particular for a beverage can, comprising:

a lid having an upper face, a lower face, and an opening;

a closure having a closure part for opening and reclosing the opening and an operating device for actuating the closure part;

the closure part being arranged on the lower face so as to be pivotable about a first axis extending substantially parallel to the lower face;

the operating device being arranged on the closure part so as to be rotatable with respect to the closure part about a second axis from a first position to a second position;

wherein the opening can be opened by rotating the operating device with respect to the closure part about the second axis into the second position at which the closure part is moveable out of a sealing engagement with the opening and can be reclosed by rotating the operating device with respect to the closure part about the second axis into the first position at which the closure part is returned into the sealing engagement with the opening, the operating device being pivotable together with the closure part about the first axis while the operating device is located in the second position about the second axis for moving the closure part out of the sealing engagement with the opening, the operating device being rotatable with respect to the closure part about the second axis between the first and second positions while remaining substantially parallel to the closure part, and the operating device being pivotable together with the closure part about the first axis as the operating device is rotated from the second position to the first position for moving the closure part back into the sealing engagement with the opening.

30. The container closure device according to claim 29, wherein the operating device includes an end that moves into engagement with the upper face of the lid while the operating device is rotated from the second position to the first position.

31. The container closure device according to claim 30, wherein the closure part is arranged to support rotation of the operating device about the second axis between the first and second positions without the closure part itself rotating about the second axis.

* * * * *